US007111864B2

(12) United States Patent
Mölg

(10) Patent No.: US 7,111,864 B2
(45) Date of Patent: Sep. 26, 2006

(54) DEVICE FOR SLIDING ON SNOW

(75) Inventor: Harald Mölg, Kundl (AT)

(73) Assignee: Kneissl Tirol GmbH, Kufstein (AT)

( * ) Notice: Subject to any disclaimer, the term of this patent is extended or adjusted under 35 U.S.C. 154(b) by 0 days.

(21) Appl. No.: 11/123,451

(22) Filed: May 6, 2005

(65) Prior Publication Data

US 2005/0212261 A1 Sep. 29, 2005

(30) Foreign Application Priority Data

Dec. 17, 2003 (DE) ..... 103 59 228
Dec. 14, 2004 (WO) ..... PCT/EP04/14245

(51) Int. Cl.
*A63C 5/04* (2006.01)

(52) U.S. Cl. ..... 280/609; 280/608

(58) Field of Classification Search ..... 280/609, 280/608, 601, 600
See application file for complete search history.

(56) References Cited

U.S. PATENT DOCUMENTS

| | | | | |
|---|---|---|---|---|
| 2,735,115 | A * | 2/1956 | Dees | 441/65 |
| 3,148,392 | A * | 9/1964 | Bennett | 441/68 |
| 3,374,003 | A * | 3/1968 | Fulsom | 280/18 |
| 3,378,275 | A * | 4/1968 | Rockwood et al. | 441/68 |
| 3,817,544 | A * | 6/1974 | Labelle | 280/28 |
| 5,462,304 | A * | 10/1995 | Nyman | 280/609 |
| 5,871,224 | A * | 2/1999 | Vance | 280/608 |
| 5,876,056 | A | 3/1999 | Karlsen | |
| 6,189,912 | B1 * | 2/2001 | Ritzinger | 280/609 |
| 6,193,244 | B1 * | 2/2001 | Vance | 280/14.22 |
| 6,276,699 | B1 * | 8/2001 | Simmons et al. | 280/28 |
| 6,631,912 | B1 * | 10/2003 | Metheny | 280/28 |
| 6,708,989 | B1 * | 3/2004 | Braun | 280/7.12 |
| 2002/0149174 | A1 * | 10/2002 | Cormican | 280/609 |
| 2003/0122350 | A1 * | 7/2003 | Vance | 280/609 |
| 2004/0032113 | A1 * | 2/2004 | Rancon et al. | 280/609 |
| 2004/0084879 | A1 | 5/2004 | Wilson | |
| 2004/0262884 | A1 * | 12/2004 | Langford et al. | 280/601 |
| 2004/0262885 | A1 * | 12/2004 | Wilson | 280/609 |
| 2005/0212231 | A1 * | 9/2005 | Lachance | 280/28 |

FOREIGN PATENT DOCUMENTS

| | | |
|---|---|---|
| DE | 296 05 583 U1 | 3/1996 |
| DE | 29605583 | 5/1996 |
| DE | 296 15 441 U1 | 9/1996 |
| DE | 101 07 905 A1 | 2/2001 |
| DE | 10107905 A1 | 9/2002 |
| WO | WO 02/102479 A2 | 12/2002 |
| WO | WO 03/008051 A2 | 1/2003 |

* cited by examiner

OTHER PUBLICATIONS

International Search Report dated Apr. 20, 2005 corresponding to international application No. PCT/EP04/014245.

*Primary Examiner*—J. Allen Shriver
(74) *Attorney, Agent, or Firm*—Knobbe Martens Olson & Bear LLP

(57) ABSTRACT

Device for sliding on snow, especially a carving ski, having a base running face, which extends over a front, a central and a rear zone and which is waisted in the longitudinal direction, wherein in the front and/or in the rear zone of the base running face, the latter is overlaid by at least one additional running-face segment which, together with a portion, especially the central portion, of the base running face defines a second running face having a second waist with a substantially larger radius of curvature.

6 Claims, 4 Drawing Sheets

DEVICE FOR SLIDING ON SNOW

CROSS-REFERENCE TO RELATED APPLICATIONS

This application claims priority under 35 U.S.C. Section 365(C) to International Application No. PCT/EP2004/014245, the disclosure of which is hereby incorporated by reference in its entirety.

BACKGROUND

1. Field of the Invention

The invention relates to a device for sliding on snow, especially a carving ski, having a base running face, which extends over a front, a central and a rear zone and which is waisted in the longitudinal direction.

2. Description of the Related Art

Such devices for sliding on snow are known, for example, from alpine skiing. So-called carving skis, which are characterised by a linear arrangement having a pronounced waist in the longitudinal direction, have in the meantime become successful in such skiing. The advantage of the waisted ski is that, when the ski is set on edge, a curve is described along an active radius defined by the waist. The more waisted a ski is, theoretically the tighter the curve that can be travelled. Skis having a more pronounced waist are therefore very manoeuvrable but have a tendency, when travelling in a straight line, to become very unsteady and unstable. Conversely, a ski that is not very waisted is directionally stable when travelling in a straight line but is distinctly less manoeuvrable, and consequently more difficult to control, when travelling in a curve.

Although the conventional ski, especially the carving ski, has revolutionised travelling in curves in alpine skiing as a result of its waist, it harbours the disadvantage that the variation of curves of different radii is possible only for experienced skiers. Especially in the case of skis having a pronounced waist, even slight edging of the ski causes initiation of a curve. With inexperienced skiers, it is precisely that abrupt change in direction which more frequently leads to falls with consequences that are not less than serious.

A number of publications that seek to solve the problems mentioned above are known from the state of the art.

German Gebrauchsmuster DE 296 05 583 U1, for example, describes a so-called multi-edge ski. This is characterised in that its sliding face is composed of one or more steps, wherein a steel edge can be attached at each transition between steps. The greatest advantage of that multi-edge ski is that a multiple metal-edge length can be integrated with the length of the ski remaining the same. It is in addition also possible, however, to achieve improved manoeuvrability and ability to stay on course by means of varied waisting of the individual steps of the ski. DE '583 thus describes, for example, waisting the lowest step to a small extent, since in that way it generates good and directionally stable straight-line travel, and then making the upper steps increasingly waisted, since they achieve more contact with the snow during edging and thus, in view of their waisted form, provide better manoeuvrability of the ski. A disadvantage of such as arrangement is that differing edges with differing waists extend over the whole length of the ski. This results in the weight being high, in increased resistance when travelling in a straight line as well as when travelling in a curve and, especially in the case of a two-step construction of the ski, again leads to the problem of the abrupt change of direction. Since, depending on the edging, a different edge acts as a guide to the direction, there is no step-free intermediate region formed in that arrangement that allows a different travelling radius according to the edging.

German Offenlegungsschrift DE 101 07 905 A1 likewise describes a carving ski which, in order to solve the problems referred to above, is given a raised running face of which the outer edges run parallel to the middle of the longitudinal axis of the ski. This new, additional running face is somewhat narrower than the waist of the original running face. The ski described therein is therefore likewise of multi-step construction and accordingly has the same advantages already evident from DE '583. That disclosure naturally therefore also has the disadvantages indicated above.

The problem underlying the present invention is therefore further to develop a device for sliding on snow, especially a carving ski, in such a manner that, despite having good manoeuvrability, has straight-line travel that is simple to control even at high speeds. A further problem of the present invention is to develop a device for sliding on snow, especially a carving ski, in such a manner that it can execute curve radii that are changeable in a substantially step-free manner.

SUMMARY

This problem is solved by a device for sliding on snow, especially a carving ski, having a base running face that extends across a front, a central and a rear zone and that is waisted in the longitudinal direction, wherein in the front and/or in the rear zone of the base running face the latter is overlaid by at least one additional running-face segment which, together with a portion, especially the central portion, of the base running face defines a second running face having a second waist with a substantially larger radius of curvature.

BRIEF DESCRIPTION OF THE DRAWINGS

In the following, the invention is described by way of an embodiment example, which is explained in detail with reference to the drawings in which.

DETAILED DESCRIPTION OF THE PREFERRED EMBODIMENT

Figure 1:
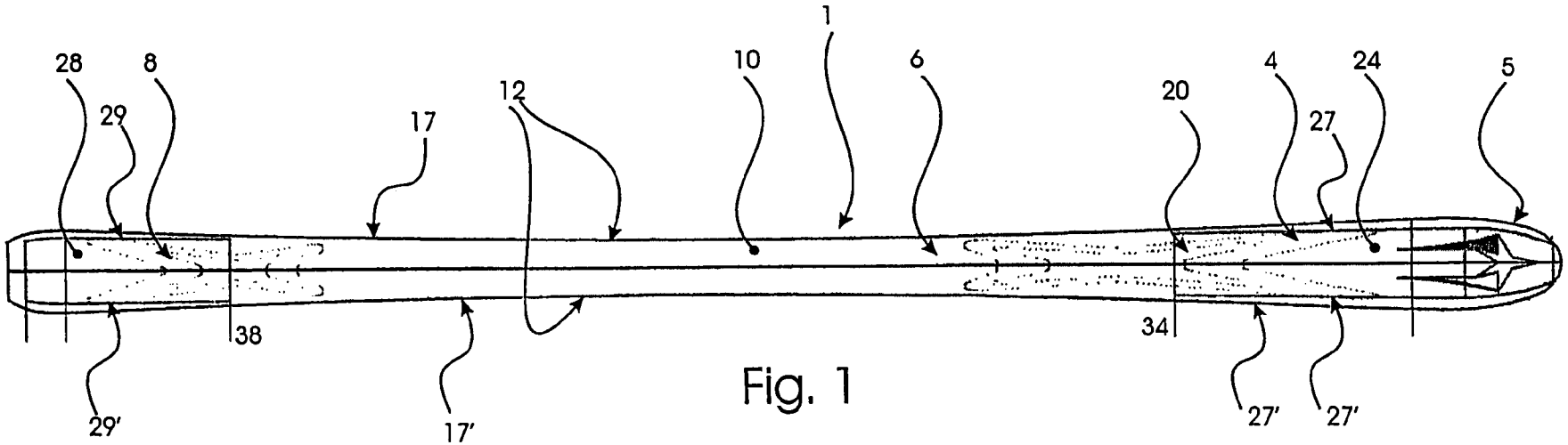
FIG. 1 is a view from below of an embodiment of the device for sliding on snow according to the invention.

From the present description, it will be appreciated that as a result of the fact that the second waist, having a substantially larger radius of curvature, is formed by a portion of the base running face and by at least one additional running-face segment, a ski is obtained that has two waists each of which defines for itself a limiting radius. Compared with the publications mentioned at the outset, which have a multi-step ski construction, the device for sliding on snow proposed herein is somewhat lighter. In addition, the use of a commonly exploited base running face in the central zone of the device for sliding on snow results in an optimised running face, since no edges or step arrangements conflict in an impeding manner with the sliding. The formation of the second waist with a substantially greater radius of curvature compared with the waist of the base running face—referred to hereinafter as base waist—results, when the ski is not set on edge, in the ski having appreciably improved straight-line travel. As the ski is edged, increasingly the second waist engages, there being formed at that point a mixed region. According to the angle at which the ski is set on edge, an active edge is formed that defines the active, that is the effective, radius of the ski. Thus, in the case of the present embodiment, a device for sliding on snow, especially a ski or carving ski, is obtained that is not restricted by its fixed lateral geometry and hence suitable to a greater or lesser extent for short or long sweeps, but that is capable of executing a radius that is changeable in step-free manner according to the edging angle. The carving, that is travelling on the edge, of short as well as long sweeps is consequently possible. By the successive transition from the second waist to the base waist—according to the angle at which the ski is set on edge—in addition a "servo effect" is created in respect of the steering of the ski and the control behaviour. As the ski is set on edge, the result is not an abrupt change of direction but a cautious approach towards a maximum radius of curvature that is limited by the base waist. With this device for sliding on snow, therefore, even sudden setting on edge is no longer a point of risk, since the change of direction occurs gradually and not abruptly as the ski is set on edge.

Since, as the edging angle increases, the active radius becomes correspondingly increasingly smaller, it is possible for the user continuously to change the curve radius. It can be assumed here that usually the active radius is maximum at an edging angle of approximately 0° and minimum at an edging angle of at least approximately 8–12°, especially 10°. It is naturally also possible for ski models to be graded according to field of use so as to define, for example, a slalom ski, the minimum and maximum radius of which is below that of a downhill ski, which usually requires especially large curve radii.

The curve behaviour or the straight-line travel of the ski according to the invention is substantially defined by the formation of the different waists. It has proved advantageous to form the waists substantially from one or more circular arcs constructionally matched with respect to one another. Empirical experience has shown that this is a suitable means of controlling the running properties of a device for sliding on snow. The use of constant curve radii is also one possibility of creating a waist that results in especially positive ski properties. Formation of the base waist and/or the second waist in such a manner that the radius of curvature decreases from the front zone and/or from the rear zone to the central zone of the device for sliding on snow results in a ski having pronounced "carver" properties. Such a ski follows that waist exactly when set on edge. A combination of the base waist and the second waist therefore produces a carving ski that is limited by a maximum and by a minimum curve radius, there being formed therebetween a mixed region that renders possible execution of almost any desired curve radius.

The result of forming the second waist with a substantially constant radius of curvature is that the ski—when it is not set on edge—travels exactly in a straight line, the risk of crossing the skis being minimised. In alpine skiing, such a form of arrangement represents the combination of a conventional alpine ski with a carving ski, since the manoeuvrability of the carver is combined with the exact and reliable straight-line travel of the conventional alpine ski. In addition it may be mentioned that it is naturally also possible to use a plurality of overlying running-face segments one above another, so that further additional waists three, four and so on result, which, for example, would additionally improve the edge grip when travelling in a curve.

In order to achieve precise travelling in curves, it is expedient for the base running face and the running-face segments that overlie it to be bounded laterally by steel edges or comparable edges, with the result that those edges define a corresponding "sidecut". It is naturally conceivable, depending on the required sliding properties or the fields of use of the ski, to use both different edge forms and materials. It may also be expedient for solely the base running face to be bounded by steel edges and for the overlying running-face segments only to be reinforced by plastics boundaries. It may be mentioned, in addition, here that naturally also the arrangement of track grooves, such as are known from the state of the art, may be used in order to influence the running properties of the ski.

A possibility of versatile use of the device for sliding on snow is presented by the overlying running-face segments being so formed that they are fastened to the running-face side of the device for sliding on snow in such a manner as to be detachable. Such fastening can be effected by fastening screws that are operable from the top side of the ski, by fast-action locking clips or also by tongue-and-groove constructions. The advantage of detachable fastening lies in the ability to exchange the overlying running-face segments as required. Thus, for example, the fastening of running-face segments to the ski that provide the ski with a more pronounced second waist is conceivable. This would make the ski especially manoeuvrable and create for it a very extreme minimum radius. If, on the other hand, a ski having especially stable straight-line travel is desired, adaptation in that respect can be effected by exchanging the overlying running-face segments. The use of running-face segments that create a less-pronounced second waist for the ski leads to stable straight-line travel. It is naturally also possible not only to adapt the running-face segments to snow conditions that vary in themselves but also to provide running-face segments that, when they have become worn, are simply exchanged for new running-face segments.

An advantageous further development is the formation of running-face segments that each extend in a direction towards the front or the rear, rising increasingly from the base running layer. The ski has a changed response behaviour to the edging, depending on the magnitude of that rise. It is naturally also possible for the overlying running-face segments to be formed in such a manner that the rise is adjustable. This can be effected, as already mentioned hereinbefore in respect of fastening the overlying running-face segments to the body of the ski, by means of adjusting screws that are operable from the top of the ski. Naturally, the provision of running-face segments that are differently formed in that respect, which the user fastens to his device for sliding on snow, especially his ski, as required, is also conceivable.

It is consequently likewise of advantage to fasten the overlying running-face segments to the ski with resilient elements interposed, especially an elastomeric layer having a shock-absorbing action. Such a resilient bearing arrangement provides shock absorption for the ski and thus increases the controllability and ride comfort. It is naturally also possible for such an intermediate layer not only to be formed as a resilient intermediate layer but also to be supplemented by thermoplastic elements that bring about a changed stiffness of the ski according to the surrounding temperature.

Referring now to specific embodiments, FIG. 1 is a view from below of a device for sliding on snow according to the invention, that is, a ski. The ski 1 comprises a front zone 4, a central zone 6 and a rear zone 8. A base running face 10 extends across those three zones (4, 6, 8). The ski 1 shown here is a typical carving ski having a pronounced base waist 12. Such a waist 12 allows certain curve radii to be executed by edging the ski about its longitudinal axis. In order not to lose the required adhesion to the ground and longitudinal steering during travel in a curve, the ski, as is generally known from the state of the art, has steel edges 17, 17'. In addition, also known from the state of the art, the ski 1 comprises a shovel 5 in the front zone 4 (see FIG. 2). According to the invention, in the front zone 4 and in the rear zone 8 the ski 1 shown comprises, in each case, an additional overlying running-face segment 24 and 28, respectively. The running-face segment is in this instance (see FIG. 2) fastened at the running face side 2 to the base running face of the ski 1 using fastening means, especially screws. It is clear in FIG. 1 that those overlying running-face segments 24, 28 are narrower than the base running face 10. In addition, the radius of curvature of those running-face segments 24, 28 is smaller in the corresponding region than the radius of curvature of the base waist 12 of the base running face 10. In order to ensure good sliding properties, the overlying running-face segments 24, 28 are so formed that a tangential transition exists between the base running face 10 in the central zone 6 of the ski and the overlying running-face segments 24, 28.

Figure 2:
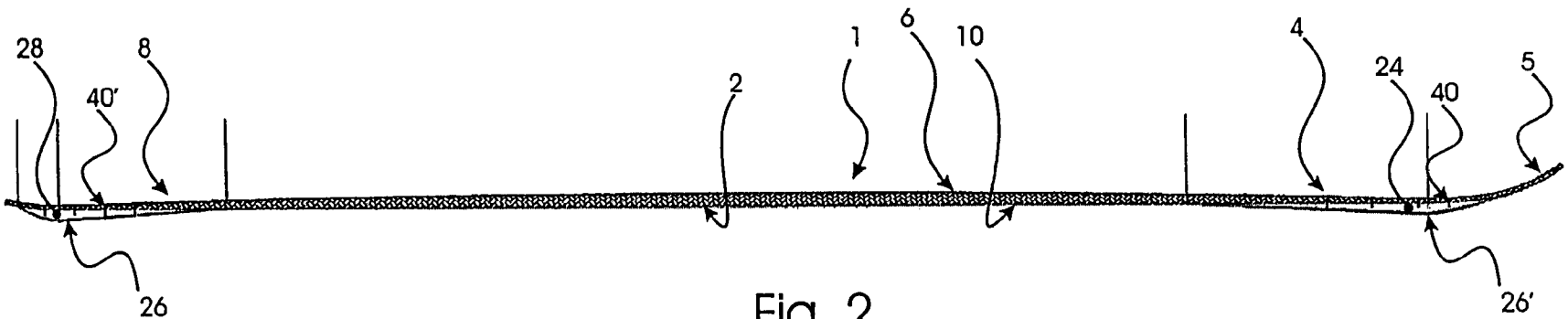
FIG. 2 is a side view of the embodiment according to FIG. 1.

It can be seen in FIG. 2 that the overlying running-face segments 24, 28 rise up from the base running face 10 in the front zone 4 and in the rear zone 8. Those rises 26, 26' allow adaptation of the response behaviour of the ski 1. The greater the rise 26, 26', the more the ski has to be edged in order for the steel edges 17, 27, 29 and 17', 27' 29' to act as steering edges, that is, active edges. More detail concerning the steering behaviour of those edges and the so-called active edge is given in FIGS. 3 to 5.

The fastening elements 40, 40' shown in FIG. 2 allow for the overlying running-face segments 24, 28 to be fastened to the ski 1 so as to be detachable. It is therefore possible for the overlying running-face segments 24, 28 to be exchanged and replaced by others in accordance with the desired behaviour of the ski or surrounding conditions, that is, straight-line travel, manoeuvrability, temperature conditions etc. It is naturally also possible to provide the ski 1 with an overlying running-face segment 24 only in the front zone 4, if that is desired, or for that segment 24 to be overlaid with at least one further segment. The same naturally applies also to the rear zone 8. Subdivision of the base running face 10 into segments at the transition zone 34 or 38 (shown in FIG. 1) is furthermore also conceivable, so that, for example, the base running face 10 can be fastened to the ski 1 so as to be detachable in the central zone 6. This allows for the base running face to be exchanged, in order possibly to adapt it to altered snow conditions or to carry out reworking of the face.

Figures 3, 4, 5:
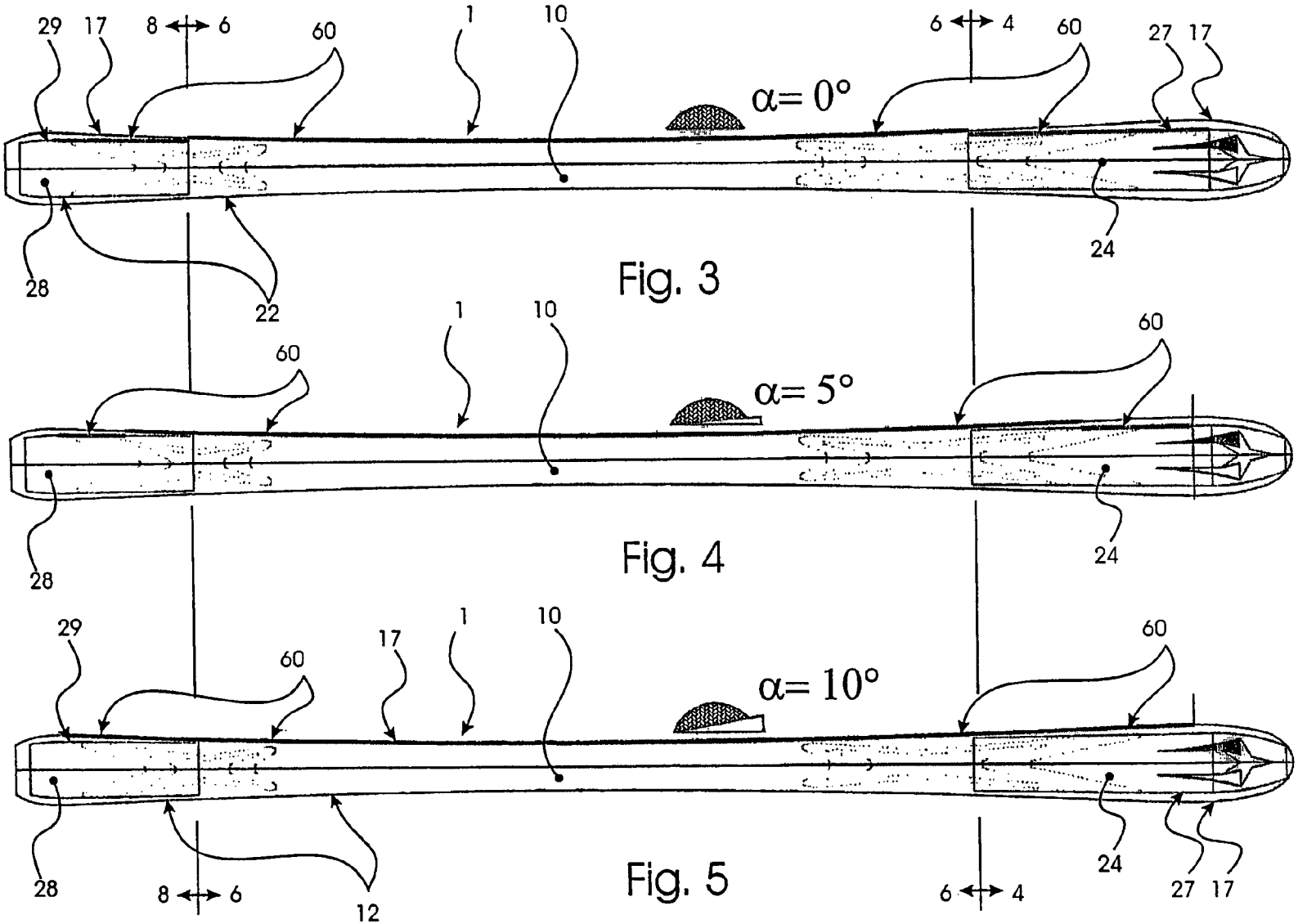
FIGS. 3, 4 and 5 show, in a diagrammatic view from below, the formation of an active edge, in respect of the exemplary embodiment according to FIG. 1, as a function of the edging angle.

FIGS. 3 to 5 show the mode of operation of the edge arrangement or running face arrangement according to the invention of the ski 1. At an edging angle $\alpha$ of 0°, the second waist 22 of the ski 1 acts as steering means. As can be seen in FIG. 3, that second waist 22 is composed of the base waist 12 in the central zone 6 of the ski 1 and the second waist 22 of the overlying running-face segments 24, 28. At an edging angle $\alpha$ of, for example, 0°, the second waist 22 acts as steering means for the ski and, on account of the very small curvature, brings about stable straight-line travel.

If, as can be seen in FIGS. 4 and 5, the edging angle $\alpha$ is increased, that is, the skier edges the ski over the longitudinal axis, the result is a change in the active edge. At an edging angle $\alpha$ of approximately 0°, the active edge is formed by the waist 2. At an edging angle of, for example, 10° or above, the base waist 12 forms the active edge. As can be seen in FIGS. 3 and 5, the active edge from FIG. 3, formed by the central zone 6 of the base waist 12 and the regions of the waist of the overlying running-face segments 24, 28 in the front zone 4 and in the rear zone 8, has a very much smaller radius of curvature than the active edge in FIG. 5, which is formed solely by the base waist 12. The result of this is that, at an edging angle $\alpha$ of at least 10°, a minimum radius can be travelled and the ski is therefore curve-oriented.

The mixed region, that is, therefore, the region having an edging angle $\alpha$ between 0° and, for example, 10°, is shown diagrammatically in FIG. 4. It can be seen here that the active edge varies according to the edging angle $\alpha$. If the edging angle $\alpha$ becomes greater, the active edge in the front and in the rear zone 4, 8 is increasingly formed by the base waist. If it becomes smaller, the edge of the overlying running-face segments 24, 28 in those zones serves as the steering means. Consequently, the ski 1 according to the invention does not, like that known from the state of the art, have essentially only one fixed curve radius, but renders possible almost step-free variation of the curve radius within the limiting radii, which are defined by the base waist 12, and by the mixed second waist 22 shown in FIG. 3. The ski according to the invention is accordingly a device for sliding on snow that, owing to its novel "three-dimensional" running-face formation, is substantially more versatile, easier to use and easier to control.

Figure 6:
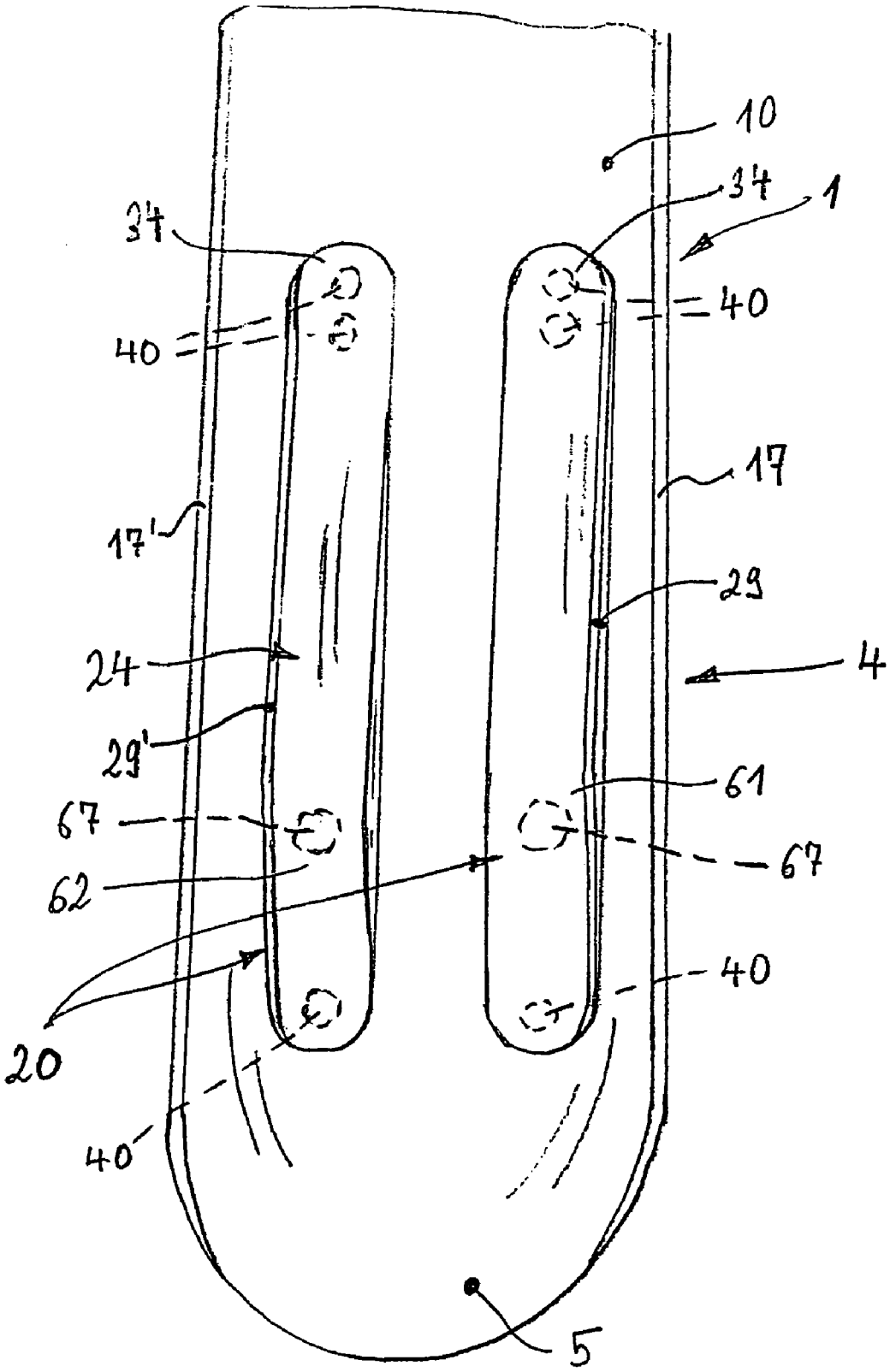
FIG. 6 is a perspective view of the running layer, from the front, of a second embodiment of a ski constructed according to the invention having runner-like running-layer inserts.
Figure 7:
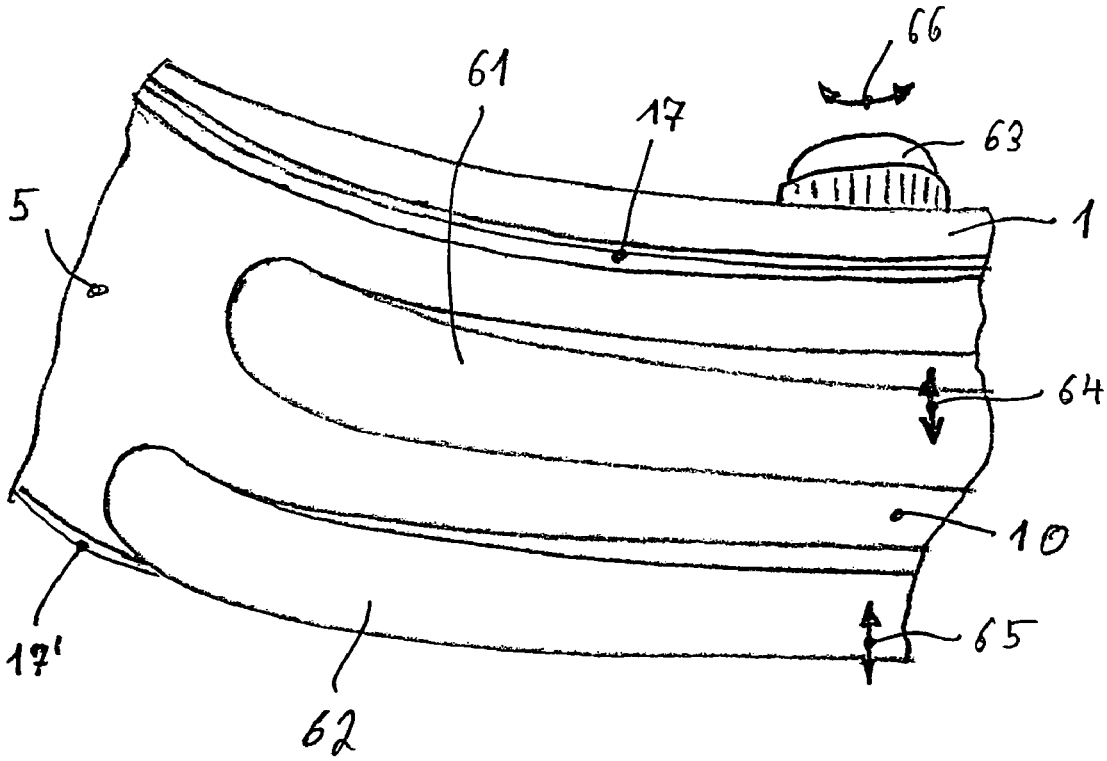
FIG. 7 is a lateral-inclined perspective view of a portion of the embodiment according to FIG. 6.

In an especially preferred embodiment, which is also claimed as important to the invention independently of the construction described above, the overlying running-face segments 24, 28 are each of runner-like construction, especially in the form of running-face strips 61, 62 inserted separately in the base running face. The front zone of a ski formed in such a manner is shown in FIGS. 6 and 7. Those separate running-face strips 61, 62 are, in a further embodiment, arranged to be movable out of the base running face 10 either stepwise or continuously, and especially in such a manner that they extend outwards from the base running face 10 approximately in the shape of a wedge towards the front (this applies to the front running-face strips) and towards the rear (this applies to the rear running-face strips).

For that purpose, there may be associated with the running-face strips adjusting screws 63 by means of which the running-face strips 61, 62 are movable outwards to a greater or lesser extent beyond the base running face. In such an arrangement a separate adjusting screw may be associated with each individual running-face strip, with the result that the individual running-face strips can individually be "unscrewed" to a greater or lesser extent from the base running face as desired by the user. Preferably, however, joint adjusting screws are associated with the front and rear running-face strips in each case. Corresponding to each of FIGS. 6 and 7, arranged at the front (the same applying also to the rear) are two separate running-face strips 61, 62 which extend parallel to each other and which are adjustable either individually or together.

Riding tests have shown that it is advantageous when the separate running-face strips 61, 62 are movable out by between 0 mm and a maximum of approximately 3.0 mm, especially approximately 2.5 mm, beyond the base running face 10. Naturally, the "sidecut" of the overlying running-face segments 61, 62 is not altered by the adjustment possibility. Only the so-called "edging angle" can be influenced by the said adjusting screws 63, that is, the angle at which the outer edge 29 or 29' of the running face strips 61, 62 acts. In the case of individual adjustment of the running-face strips 61, 62, the edging angle can be differently adjusted on the inside and the outside.

In particular, the last-illustrated embodiment also allows the return of the running-face strips into the base face in such a manner that they finish flush with the base face. It is therefore possible for a conventional running layer to be set by the user.

In FIG. 7, the possibility of adjusting the additionally inserted runner-like running-face strips 61, 62 relative to the base running face 10 is indicated by the double arrows 64, 65. For that purpose, the adjusting screw 63 needs to be turned either to the left or to the right according to the double arrow 66. Corresponding to the first embodiment, the additionally inserted runner-like running-face strips 61, 62 each have steel edges 29, 29' at the outside (see FIG. 6). In FIG. 6, the supporting of the adjusting screw 63, which can be operated from the top face of the ski, against the ski inner side of the running face strips 61, 62, is indicated in each strip by the reference numeral 67.

At this point attention is drawn to the fact that all of the parts described above, alone or in any combination, especially the details shown in the drawings, are claimed as being important to the invention. Variations thereof are familiar to the person skilled in the art.

What is claimed is:

1. A carving ski or other device for sliding on snow, said device comprising:

a front zone, a central zone, a rear zone, and a base running face having an outer perimeter, said base running face extending over said front, central and rear zones, and said base running face being waisted in the longitudinal direction, wherein in the front and/or in the rear zone of said base running face, said base running face is overlaid by at least one additional running-face segment having at least two edges generally extending in the longitudinal direction such that at least portions of both edges of said overlying running-face segment are located inward of the outer perimeter, and said overlying running-face segment(s) is/are each of runner-like construction or are running-face strips inserted separately in the base running face, wherein the front running-face strips in the front zone and the rear running-face strips in the rear zone of the device for sliding on snow are movable out to a greater or lesser extent beyond the base running face by means of adjusting screws operable from the top face of the device for sliding on snow.

2. A carving ski or other device for sliding on snow, said device comprising:

a front zone, a central zone, a rear zone, and a base running face having an outer perimeter, said base running face extending over said front, central and rear zones, and said base running face being waisted in the longitudinal direction, wherein in the front and/or in the rear zone of said base running face, said base running face is overlaid by at least one additional running-face segment having at least two edges generally extending in the longitudinal direction such that at least portions of both edges of said overlying running-face segment are located inward of the outer perimeter, and said overlying running-face segment(s) is/are each of runner-like construction or are running-face strips inserted separately in the base running face, wherein the separate running-face strips are movable out beyond the base running face by from 0 mm up to a maximum of approximately 3.0 mm.

3. A carving ski or other device for sliding on snow, said device comprising:

a front zone, a central zone, a rear zone, and a base running face having an outer perimeter, said base running face extending over said front, central and rear zones, and said base running face being waisted in the longitudinal direction, wherein in the front and/or in the rear zone of said base running face, said base running face is overlaid by at least one additional running-face segment having at least two edges generally extending in the longitudinal direction such that at least portions of both edges of said overlying running-face segment are located inward of the outer perimeter, and said overlying running-face segment(s) is/are each of runner-like construction or are running-face strips inserted separately in the base running face, wherein there are arranged at the front and/or at the rear, respectively, two separate runner-like running-face strips which extend approximately parallel to each other and said running-face strips are adjustable either together or individually.

4. A carving ski or other device for sliding on snow, said device comprising:

a front zone, a central zone, a rear zone, and a base running face, said base running face extending over said front, central and rear zones, and said running face being waisted in the longitudinal direction, wherein in the front and/or in the rear zone of said base running face, said base running face is overlaid by at least one additional running-face segment, and said overlying running-face segment(s) is/are each of runner-like construction or are running-face strips inserted separately in the base running face, wherein the front running-face strips in the front zone and the rear running-face strips in the rear zone of the device for sliding on snow are movable out to a greater or lesser extent beyond the base running face by means of adjusting screws operable from the top face of the device for sliding on snow.

5. A carving ski or other device for sliding on snow, said device comprising:

a front zone, a central zone, a rear zone, and a base running face, said base running face extending over said front, central and rear zones, and said running face being waisted in the longitudinal direction, wherein in the front and/or in the rear zone of said base running face, said base running face is overlaid by at least one additional running-face segment, and said overlying running-face segment(s) is/are each of runner-like construction or are running-face strips inserted separately in the base running face, wherein the separate running-face strips are movable out beyond the base running face by from 0 mm up to a maximum of approximately 3.0 mm.

6. A carving ski or other device for sliding on snow, said device comprising:

a front zone, a central zone, a rear zone, and a base running face, said base running face extending over said front, central and rear zones, and said running face being waisted in the longitudinal direction, wherein in the front and/or in the rear zone of said base running face, said base running face is overlaid by at least one additional running-face segment, and said overlying running-face segment(s) is/are each of runner-like construction or are running-face strips inserted separately in the base running face, wherein there are arranged at the front and/or at the rear, respectively, two separate runner-like running-face strips which extend approximately parallel to each other and said running-face strips are adjustable either together or individually.

* * * * *